US010461450B2

(12) United States Patent
Hensley et al.

(10) Patent No.: US 10,461,450 B2
(45) Date of Patent: Oct. 29, 2019

(54) SIGNAL CONNECTOR BRACES

(71) Applicant: Hewlett Packard Enterprise Development LP, Houston, TX (US)

(72) Inventors: James D. Hensley, Rocklin, CA (US); David R. Cowles, Granite Bay, CA (US); David G. Rohrer, Auburn, CA (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/657,870

(22) Filed: Jul. 24, 2017

(65) Prior Publication Data

US 2019/0027845 A1 Jan. 24, 2019

(51) Int. Cl.
*H01R 12/00* (2006.01)
*H01R 12/70* (2011.01)

(52) U.S. Cl.
CPC ..... *H01R 12/7052* (2013.01); *H01R 12/7047* (2013.01)

(58) Field of Classification Search
CPC ..... H01R 12/7052; H01R 12/7047
USPC ..... 439/79, 80, 607.07
See application file for complete search history.

(56) References Cited

U.S. PATENT DOCUMENTS

| | | | | |
|---|---|---|---|---|
| 4,025,142 | A | 5/1977 | Huber et al. | |
| 6,095,856 | A | 8/2000 | Horan et al. | |
| 6,974,344 | B2 | 12/2005 | Comerci | |
| 7,347,719 | B2 | 3/2008 | Geibel et al. | |
| 9,917,405 | B2 * | 3/2018 | Ju | H01R 13/6585 |
| 9,972,946 | B2 * | 5/2018 | Ju | H01R 13/6585 |
| 10,109,967 | B2 * | 10/2018 | Zhao | H01R 13/6586 |
| 2003/0166349 | A1 | 9/2003 | Huss, Jr. et al. | |

* cited by examiner

*Primary Examiner* — Khiem M Nguyen
(74) *Attorney, Agent, or Firm* — Park, Vaughan, Flemming & Dowler LLC

(57) ABSTRACT

Example implementations relate signal connector braces. For instance, in an example a signal connector brace can include a housing having an exterior surface, and a protrusion extending from the housing to couple the housing to a via of a circuit board thereby positioning the exterior surface of the housing in contact with a corresponding exterior surface of a signal connector to brace the signal connector.

17 Claims, 5 Drawing Sheets

SIGNAL CONNECTOR BRACES

BACKGROUND

Electronic devices may include a circuit board such as a printed circuit board (PCB). Electrical components of the electronic device may be coupled to the PCB. For instance, the electrical components may include a protrusion to couple the electrical components to a via of a circuit board. The via may be plated-through hole that is connected to trace layers in the circuit board. As such, the electrical components can be electrically and mechanically coupled to the circuit board and provide various functions of the electronic device.

DETAILED DESCRIPTION

As mentioned, electrical components can be electrically and mechanically coupled to the circuit board of an electronic device to provide various functions. For instance, an electronic device may include various signal connectors to couple to additional devices and/or couple to various cables that are external to the electronic device. As used herein, a signal connector refers to an electro-mechanical connector. Examples of signal connector include pin to pin connectors such as right-angle back plane connector, among other types of signal connectors.

Signal connectors may be subject to stress during an operational lifetime of an electronic device. For instance, signal connectors may be subject to shearing forces due to vibration and/or shock forces imparted on the signal connectors. Such shearing forces can be particularly evident when the signal connector is coupled to an additional device and/or cable. The signal connectors may be damaged and/or be mechanically and/or electrically decoupled from the circuit board by the shearing forces and therefore may not function as intended. As such, some approaches have attempted to prevent or mitigate the effects of stress on the signal connectors through replacement with a more robust replacement signal connector having a thicker housing and/or having various mechanical fasteners (e.g., screws, bolts, etc.) which may affix the replacement signal connector to a circuit board. However, such replacement may be time consuming and/or expensive.

Accordingly, the disclosure is directed to signal connector braces. As detailed herein, signal connector braces can desirably provide mechanical support to a signal connector to mitigate or eliminate the impact of mechanical stresses imparted on the signal connector without having to incur a cost and/or experience development time associated with a replacement signal connector. In various examples, a signal connector brace can include a housing having an exterior surface and a protrusion extending from the housing to couple the housing to a via of a circuit board thereby positioning the exterior surface of the housing in contact with a corresponding exterior surface of a signal cable to brace the signal connector. As used herein, "in contact with" refers to physical contact between two or more separate and distinct components.

Figure 1:
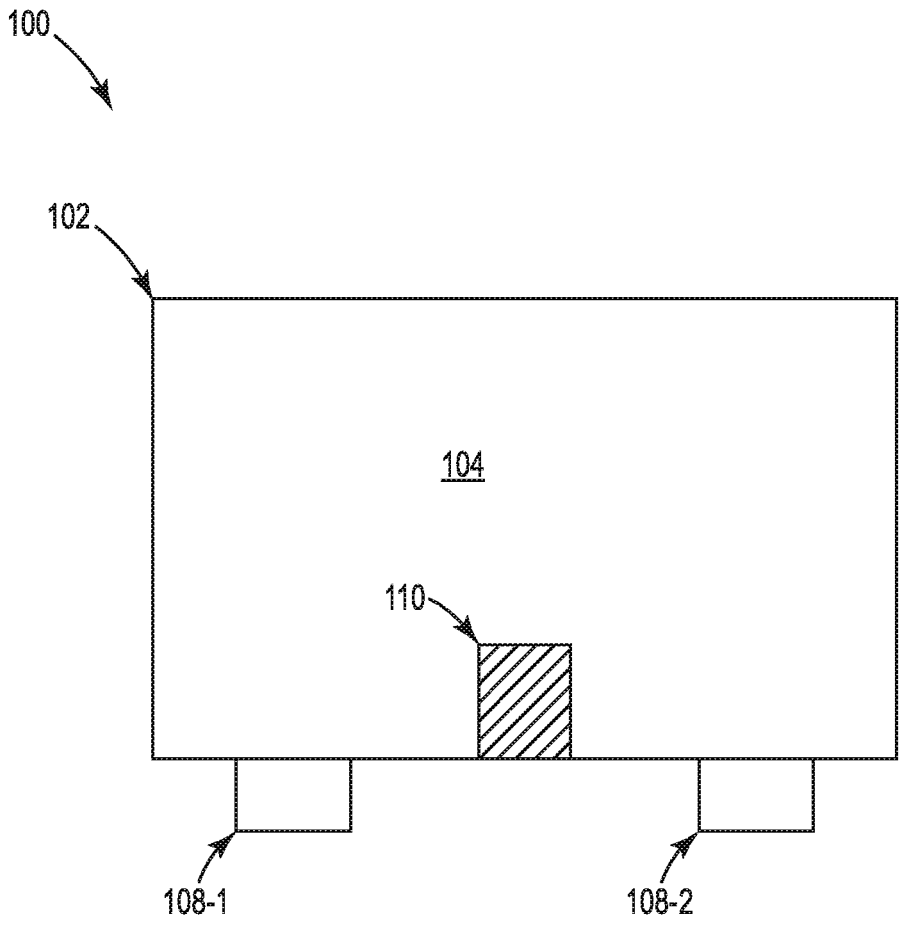
FIG. 1 illustrates an example of a diagram of a signal connector brace according to the disclosure.

FIG. 1 illustrates an example of a diagram of a signal connector brace 100 according to the disclosure. As illustrated in FIG. 1, the signal connector brace 100 can include a housing 102 and a protrusion such as a first protrusion 108-1 and/or a second protrusion 108-2 (referred to herein generally as protrusion 108).

The housing 102 can form an exterior surface 104 of the signal connector brace 100. As detailed herein, the exterior surface 104 of the signal connector brace can be in contact with a corresponding exterior surface of a signal connector. The housing 102 can include an internal volume (e.g., air filled or filled by another material than the housing) or the entire signal connector brace 100 can be formed of the same material as the housing 102. The housing 102 can be formed of metal and/or plastic, among other suitable material to promote the signal connector braces.

In some examples, the signal connector brace 100 is signal connector free. Stated differently, neither the housing 102 nor the protrusion, such as the first protrusion 108-1 and/or the second protrusion 108-2, include a signal connector. That is, the signal connector brace 100 does not include a signal connector. As such, a cost associated with the signal connector brace 100 is minimized and/or electrical interference is minimized due to the absence of the signal connector in contrast to other approaches that employ replacement signal connectors.

The protrusion 108 can be a through hole solder protrusion or a press-fit protrusion, among other suitable types of protrusions. As used herein, a through hole solder protrusion refers to a connector which is soldered or intended to be soldered into a circuit board such as into a via of a PCB to function as intended. As used herein, a press-fit protrusion refers to a connector which is friction fit (without solder) or intended to be friction fit (without solder) into a circuit board such as into a via of a PCB to function as intended. In some examples, the signal connector brace 100 can include a protrusion such as a press fit protrusion. For instance, both the first protrusion 108-1 and the second protrusion 108-2 can be a press fit protrusion, among other possibilities. Regardless, the protrusion 108 is to couple the housing 102 to a circuit board such as a PCB, as described herein.

The protrusion 108 can be integral with the housing 102 and can be formed of a same or different material as the housing 102. For instance, the protrusion can be formed of a same metal and/or plastic material as the housing 102, among other suitable material to promote the signal connector braces. However, in some examples, the protrusion can be formed at least in part of a different material from the housing.

As illustrated in FIG. 1, the signal connector brace 100 can include a total of two protrusions illustrated as the first protrusion 108-1 and as the second protrusion 108-2. However, the disclosure is not so limited. Rather, a total number, shape, and/or relative orientation of the protrusions can be varied. For example, a total number of the protrusion 108 can be varied to include more protrusions or less protrusions. For instance, in some examples, the signal connector brace 100 can include either of the first protrusion or the second protrusion but not the other of the first protrusion 108-1 or the second protrusion 108-2 resulting in a total number of one protrusion in the signal connector brace 100.

In some examples, the signal connector brace 100 include a recess 110. The recess 110 can receive a mechanical fastener (e.g., mechanical fastener 312 as described herein with respect to FIG. 3). For example, the recess can be a threaded recess to receive corresponding threads on a screw, among other possibilities. Regardless, the recess 110 can receive a mechanical fastener to disposition and/or otherwise tension the signal connector brace 100 against a circuit board such as those described herein. However, in some examples the signal connector brace 100 can be formed without a recess such as recess 110. In such examples, the protrusion 108 can alone couple and disposition the signal connector brace 100 against a circuit board.

Figure 2:
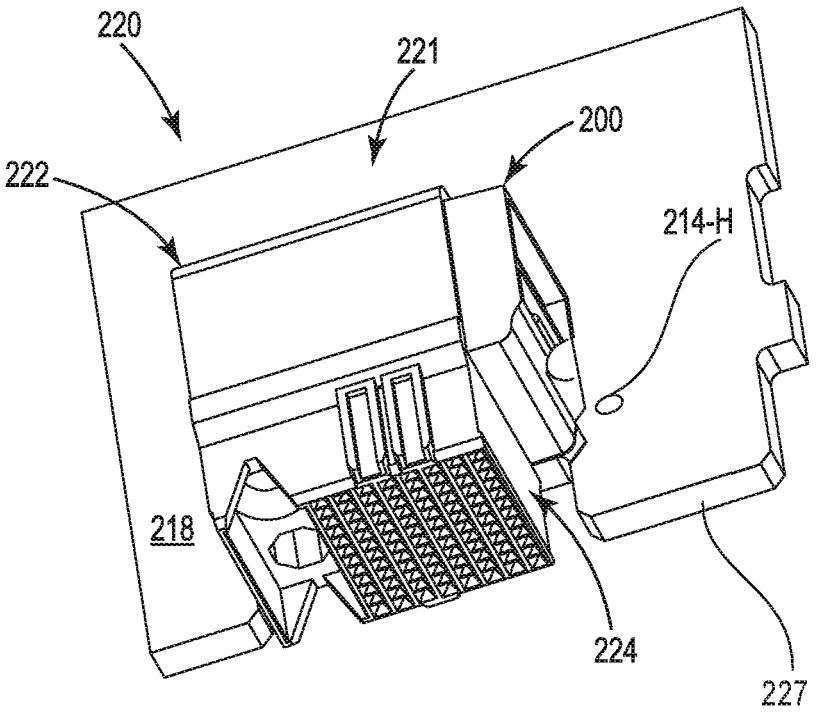
FIG. 2 illustrates an example of a diagram of a portion of a device having a system including a signal connector and a signal connector brace according to the disclosure.

FIG. 2 illustrates an example of a diagram of a portion of a device 220 having a system 221 including a signal connector 222 and a signal connector brace 200 according to the disclosure. Examples of the device 220 include a station (such as a mobile phone, a wearable electronic device, a tablet, a laptop computer, a desktop computer, etc.), a server, a wireless access point, a switch, a router, a controller, or combinations thereof, among other possible types of devices suitable with signal connector blocks.

As used herein, the term "station" can, for example, refer to a device that has the capability to use the Institute of Electrical and Electronics Engineers (IEEE) 802.11 protocol. In some examples, a station may be a device that contains an IEEE 802.11-conformant media access control (MAC) and physical layer (PHY) interface to a wireless medium (WM). As used herein, the term "access point" can, for example, refer to receiving points for any known or convenient wireless technology which may later become known. As an example, an 'access point' can refer to receiving points for any known or convenient wireless access technology which may later become known. As used herein, the term "controller" can, for example, refer to a WLAN controller that performs load balancing operations, authentication operations, interference detection and avoidance operations, and/or coverage hole detection and correction operations for the network. As used herein, the term "switch" can, for example, refer to a computer networking device that connects devices together on a network by using, for example, packet switching to receive, process and forward data to a destination device. For example, a switch can include memory, including read-write memory, and a hierarch of persistent memory such as ROM, EPROM, and Flash memory. As used herein, the term "router" can, for example, refer to a networking device that forwards data packets between networks In some examples, the device 220 can be an all-in-one (AIO) computer. As used herein, an AIO computer refers to a computer which integrates the internal components into the same case as the display, offer the touch input functionality of the tablet devices while also providing the processing power and viewing area of desktop computing systems.

The device 220 can include a circuit board 218. For instance, the circuit board 218 can be a PCB or a printed circuit board assembly (PCBA), among other possibilities. As used herein, a PCB refers to circuit board suitable to electrically connect and mechanically support various electrical components. Examples of PCBs include single sided PCB, double sided PCB, and/or multi-layered PCBs, among other types of PCBs. As used herein, a PCBA refers to PCB that has undergo post processing such as printing of solder paste on the PCB and/or undergone mounting of various electrical components such as capacitors, resistors, integrated circuits, among other types of electrical components.

The circuit board can include a via such as via 214-H, as described herein. The circuit board 218 can include or can be coupled to an operating system (not shown) of the device 220. That is, in various examples, the circuit board 218 can include an operating system which can cause the device to perform a variety of functions. In some examples, the circuit board can include a power source such as source of direct current (DC) and/or a source of alternating current (AC). Examples of power sources include batteries, AC/DC power converters, and/or DC/AC power converters, among other types of power sources.

The signal connector can include a plurality of exterior surfaces such as exterior surface 224. In various examples, an exterior surface (e.g., exterior surface 104 as described in FIG. 1) can contact the exterior surface 224 (i.e., a corresponding exterior surface adjacent to an exterior surface of the signal connector brace) of the signal connector. While the exterior surface 224 is illustrated as being substantially coplanar with the corresponding exterior surface, other orientations are possible to promote aspects of signal connector braces as described herein.

As illustrated in FIG. 2, the exterior surface 224 can be substantially orthogonal to a perimeter of the device 220 to brace the signal connector 222 at least from forces applied along a plane that is coplanar to a portion 227 of a perimeter of the device 220. However, the signal connector brace 200 can be positioned along any exterior surface of the signal connector 222 and/or along a combination of exterior surfaces of the signal connector 222.

Figure 3:
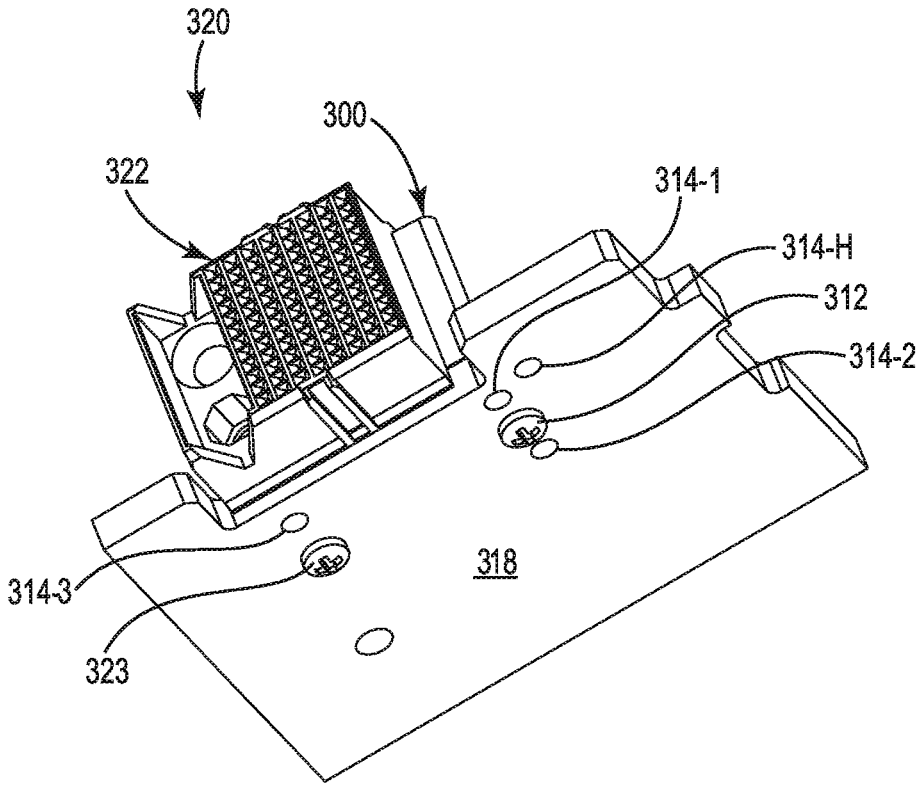
FIG. 3 illustrates another view of the example of the diagram of the device of FIG. 2 including a signal connector brace according to the disclosure.

As illustrated in FIG. 2, the system 221 include the signal connector 222 and the signal connector brace 200, as described herein. The signal connector 222 can be a pin-to-pin signal connector, among other types of signal connectors. As mentioned, the signal connector 222 can be an original (non-replacement signal connector). For instance, the signal connector 222 may include one or less mechanical fasteners in addition to a projection included in the signal connector 222. For instance, as illustrated in FIG. 3, a signal connector 322 can include one additional mechanical fastener 323 such as a screw, bolt, or other type of mechanical fastener. That is, FIG. 3 illustrates another view of the example of the diagram of the device 320 of FIG. 2 including a signal connector brace 300 according to the disclosure.

As illustrated in FIG. 3, circuit board 318 can include vias such as a first via 314-1, a second via 314-2, a third via 314-3, and a fourth via 314-H. However, while FIG. 3 illustrates a given number of vias a particular orientation the disclosure is not so limited. Rather, a total number of vias can be increased or decreased. Multiple conductive layers (not shown) can be interconnected by the vias 314-1, . . . , 314-H including connections to a conductive power plane and connections to a conductive ground plane. The vias can be through vias that extend entirely through a circuit board or the vias can extend through a portion of a thickness of the circuit board but not all the way through the thickness of the circuit board.

Figure 4:
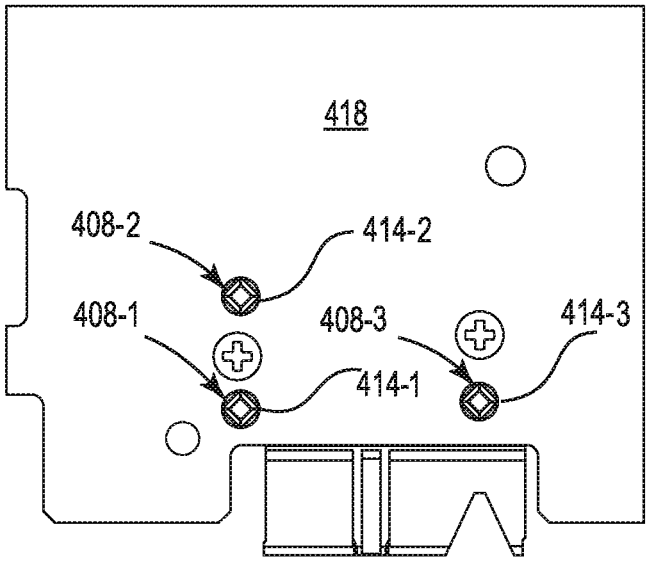
FIG. 4 illustrates a view of an example of a signal connector brace including a protrusion according to the disclosure.

FIG. 4 illustrates a view of an example of a signal connector brace including a protrusion according to the disclosure. As illustrated in FIG. 4, the protrusion can include a first protrusion 408-1 and a second protrusion 408-2. In some examples, the first protrusion 408-1 and the second protrusion 408-2 can be a press-fit protrusion. For instance, as illustrated in FIG. 4, each of the first protrusion

408-1 and the second protrusion 408-2 can be a press-fit protrusion, among other possibilities.

The first protrusion 408-1 and the second protrusion 408-2 can extend at least partially through corresponding via such as a first via 414-1 and a second via 414-2, respectively. The first protrusion 408-1 and the second protrusion can permit readily coupling a signal connector brace (e.g., signal connector brace 300 as illustrated in FIG. 3) including the first protrusion 408-1 and the second protrusion 408-2 to the first via 414-1 and the second via 414-2 of circuit board 418. Similarly, in some examples a third protrusion 408-3 can permit readily coupling a signal connector (e.g., signal connector 322 as illustrated in FIG. 3) to a third via 414-3 of the circuit board 418.

As illustrated in FIG. 4, a press-fit protrusion (e.g., the first protrusion 408-1) can taper to a distal end (located at the center point) of the protrusion. However, the press-fit protrusion can, in some example, maintain a constant cross-section along a length of the press-fit protrusion extending from a housing of the signal connector block to a distal end of the protrusion. Further, in some examples, the press-fit protrusion can have a cross-section that increase along a length of the press-fit protrusion, for instance, such that a cross-section at the distal end of the press-fit protrusion is greater than a cross-section of the press-fit protrusion at another point along the length of the press-fit protrusion.

In some examples, the first protrusion 408-1 and the second protrusion 408-2 can be symmetrical press-fit protrusions, as illustrated in FIG. 4. As used herein, a symmetrical press-fit protrusion refers to a protrusion having substantially similar parts facing around an axis such as an axis extending through a center point of the protrusion. As used herein, a "part" refers to a piece of a segment of an object such as a protrusion. As used herein, the term "substantially" can, for example, intend that the characteristic is not absolute, but is close enough so as to achieve the advantages of the characteristic. For example, "substantially similar" features is not limited to absolute similar features, and can include orientations that are intended to be similar in shape/size but due to manufacturing limitations may not be precisely similar in shape/size. For example, "substantially similar" features are at least closer in a shape and size than other different shaped or sized features. Examples of symmetrical press-fit protrusion shapes include diamond (i.e., square) shaped press-fit protrusions, as illustrated in FIG. 4, and circular shaped press-fit protrusions, among other possibilities.

The symmetrical press-fit protrusions can permit readily coupling the signal connector brace block to the circuit board and centering the symmetrical press-fit protrusions within respective vias. For instance, a center point of a symmetrical press-fit protrusion can be disposed at or near a center point of a via. As used herein, "disposed" means a location at which something is physically positioned. However, in some examples, the first protrusion 408-1 and/or the second protrusion 408-2 can be a symmetrical press-fit protrusion such as those described herein in greater detail with respect to FIG. 5. For example, the first protrusion 408-1 or the second protrusion 408-2 can be a symmetrical press-fit protrusion while the other of the first protrusion or the second protrusion 408-2 is a symmetrical press-fit protrusion, among other possibilities.

Figure 5:
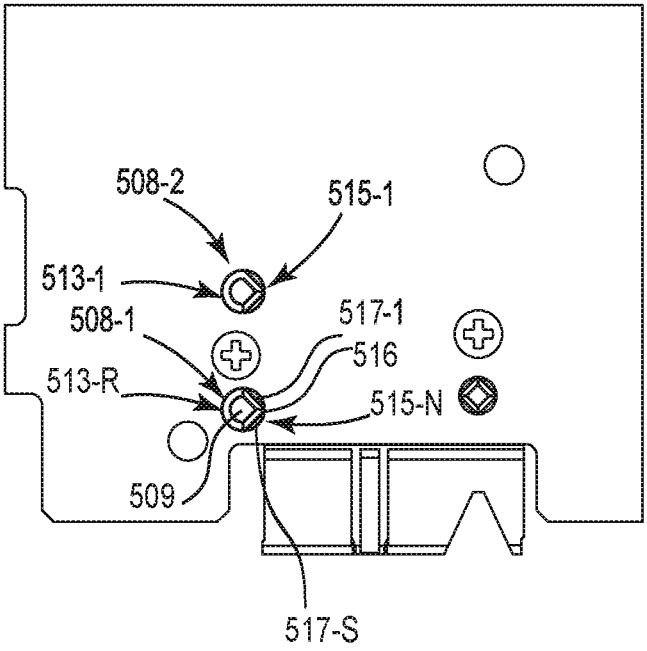
FIG. 5 illustrates a view of another example of a signal connector brace including a protrusion according to the disclosure.

FIG. 5 illustrates a view of another example of a signal connector brace including a protrusion according to the disclosure. As illustrated in FIG. 5, in some examples, a first protrusion 508-1 or a second protrusion 508-2 can be asymmetrical press-fit protrusions. As used herein, an asymmetrical press-fit protrusion refers to a protrusion having different parts facing around an axis such as an axis extending through a center point of the protrusion.

Examples of asymmetrical press-fit protrusions shapes include those having a radiused portion and a non-radiused portion, among other possibilities. For instance, as illustrated in FIG. 5, the second protrusion 508-2 can include a radiused first portion 513-1 and a non-radiused second portion 515-1. Similarly, the first protrusion 508-1 can include a radiused first portion 513-R and a non-radiused second portion 515-N. For instance, in some examples, the non-radiused second portion 515-N can extend along an along an opposite portion of the circumference from the radiused first portion 513-R of the second protrusion 508-2, as illustrated in FIG. 5.

As used herein, a radiused portion refers to a rounded or curved portion relative to an axis extending through (orthogonal to) a center point of a projection. Examples of shapes suitable as a radiused portion include a circular, oval, and/or spherical shape, among other possible rounded or curved shapes.

As used herein, a non-radiused portion refers to a non-rounded or non-curved portion. For instance, a non-radiused portion can extend to and terminate in a distal point 516 relative to an axis passing through a center point of a projection such as a center point 509 of the second projection 508-2. However, other asymmetric protrusions having other curved or non-rounded shapes are possible. For instance, those non-radiused portions including a plurality of distal points such as a "half star" shape, among other possible non-curved or non-rounded shapes.

As illustrated in FIG. 5, a distal point such as the distal point 516 may contact a surface of a via. However, in such examples, other segments such as a first segment 517-1 and a second segment 517-S of the non-radiused portion may not contact the surface of the via (when the first protrusion 508-1 is under a static force). Such orientations can promote flexing of the protrusion, for instance flexing of the protrusion toward the interface between the distal point and the surface of the via as a dynamic force is imparted on a housing of a signal connector brace including the asymmetrical press-fit projection.

In some examples, a distal point such as the distal point 516 can be disposed within a via at a predetermined orientation relative to a signal connector. For instance, a distal point can be disposed at location proximal to a signal connector, as illustrated in FIG. 5. However, a predetermined position of the distal point can be varied. For instance, in some examples a distal point can be disposed at a location distal to (opposite from the proximal location illustrated in FIG. 5) a signal connector.

The symmetrical press-fit protrusions can permit readily coupling the signal connector brace block to the circuit board and centering the symmetrical press-fit protrusions within respective vias. For instance, a center point of a symmetrical press-fit connector can be disposed at or near a center point of a via. However, in some examples, the first protrusion and/or the second protrusion can be a symmetrical press-fit protrusion. For example, the first protrusion or the second protrusion can be a symmetrical press-fit protrusion while the other of the first protrusion or the second protrusion is a symmetrical press-fit protrusion, among other possibilities.

It is noted that the signal connector and the signal connector block can be separate and distinct components. As used herein, being separate and distinct refers to each component (the signal connector and the signal connector block) having a separate housing and being without an interconnect between the devices. As used herein, an "interconnect" refers to a wired interconnect in a physical medium (e.g., electrical wire, optical fiber, cable, bus traces, etc.), a wireless interconnect (e.g., air in combination with wireless signaling technology) or a combination of these technologies. Having a signal connector and the signal connector brace as separate and distinct components can permit readily retrofitting devices including the signal connector with the signal connector brace to brace the signal connector.

In various examples, a method can be employed to provide a signal connector and provide a signal connector brace such as a signal connector brace including a housing having an exterior surface and a protrusion extending from the housing to couple the housing to a via of a circuit board thereby positioning the exterior surface of the housing in contact with a corresponding exterior surface of a signal connector to brace the signal connector. As used herein, the term "providing" refers to manufacture or procurement of an unassembled component intended for assembly into a larger system including a plurality of components such as a device including those described herein.

In some examples, the method can include coupling a signal connector brace to a circuit board. For instance, the method can include disposing a protrusion of a signal connector brace into a corresponding via of a circuit board. In some examples, the method can include disposing a mechanical fastener in a via of the circuit board and receptacle of the signal connector brace to disposition the signal connector against the circuit board. As mentioned, examples of mechanical fasteners include screws, bolts, among other types of mechanical fasteners.

Notably, in some examples, the signal connector brace can be coupled to a circuit board without the use of an adhesive or other type of permanent non-removable mechanism. This can permit removal of the signal connector brace from the circuit board as an intended application and/or demand on the circuit board changes. However, in some examples, a permanent mechanism such as solder or adhesive can be employed to couple the signal connector brace to a circuit board in a manner intended to be a non-removable.

It will be understood that when an element is referred to as being "on," "connected to", "coupled to", or "coupled with" another element, it can be directly on, connected, or coupled with the other element or intervening elements may be present. In contrast, when an object is "directly coupled to" or "directly coupled with" another element it is understood that are no intervening elements (adhesives, screws, other elements) etc.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The figures herein follow a numbering convention in which the first digit corresponds to the drawing figure number and the remaining digits identify an element or component in the drawing. For example, reference numeral 100 may refer to element 100 in FIG. 1 and an analogous element may be identified by reference numeral 200 in FIG. 2. Elements shown in the various figures herein can be added, exchanged, and/or eliminated to provide additional examples of the disclosure. In addition, the proportion and the relative scale of the elements provided in the figures are intended to illustrate the examples of the disclosure, and should not be taken in a limiting sense.

What is claimed:

1. A signal connector brace for providing mechanical support to a signal connector coupled to a circuit board, the signal connector brace comprising:

a housing having an exterior surface;

first and second protrusions extending from the housing to couple the housing to vias of the circuit board thereby positioning the exterior surface of the housing in contact with a corresponding exterior surface of the signal connector to brace the signal connector;

a recess on the housing positioned between locations where the first and second protrusions respectively join the housing, wherein the recess is configured to receive a mechanical fastener for coupling the signal connector brace to the circuit board.

2. The signal connector brace of claim 1, wherein the exterior surface of the housing is substantially coplanar to the corresponding exterior surface of the signal connector when the housing is coupled to the circuit board.

3. The signal connector brace of claim 1, wherein a respective protrusion further comprises a through hole solder signal protrusion.

4. The signal connector brace of claim 1, wherein a respective protrusion further comprises a press-fit protrusion.

5. The signal connector brace of claim 4, wherein the press-fit protrusion further comprises a symmetrical press-fit protrusion having substantially same parts around an axis extending through a center point of the press-fit protrusion.

6. The signal connector brace of claim 4, wherein the press-fit protrusion further comprises an asymmetrical press-fit protrusion having different parts around an axis extending through a center point of the press-fit protrusion.

7. The signal connector brace of claim 1, wherein the signal connector brace is signal connector free.

8. The signal connector brace of claim 1, wherein a respective signal connector brace is comprised of a plastic, a metal, or a combination thereof.

9. A system for providing mechanical support to a signal connector coupled to a circuit board, the system comprising:

a signal connector brace including:

a housing including an exterior surface;

a first protrusion and a second protrusion to couple the housing to a first via and a second via, respectively, of the circuit board thereby positioning the exterior surface of the housing in contact with a corresponding exterior surface of the signal connector to brace the signal connector; and a recess on the housing positioned between locations where the first and second protrusions respectively join the housing, wherein the recess is configured to receive a mechanical fastener for coupling the signal connector brace to the circuit board.

10. The system of claim 9, wherein the signal connector includes a third protrusion to couple the signal connector to a third via of the circuit board, and wherein the signal connector further comprises a pin-to-pin signal connector.

11. The system of claim 9, wherein the circuit board further comprises a printed circuit board (PCB).

12. The system of claim 9, wherein the circuit board further comprise a printed circuit board assembly (PCBA).

13. A device comprising:

a circuit board; and a signal connector brace coupled to the circuit board, the signal connector brace including:

a housing including an exterior surface; and first and second protrusions to couple the housing to vias of the circuit board to cause the exterior surface of the housing to contact a corresponding exterior surface of a signal connector and brace the signal connector; and a recess on the housing positioned between locations where the first and second protrusions respectively join the housing, wherein the recess is configured to receive a mechanical fastener for coupling the signal connector brace to the circuit board.

14. The device of claim 13, wherein exterior surface is substantially orthogonal to a plane of a perimeter of the circuit board.

15. The device of claim 13, wherein a respective protrusion further comprises an asymmetrical press-fit protrusion having a radiused portion and a non-radiused portion.

16. The device of claim 15, wherein the non-radiused portion is opposite the radiused portion along a circumference of the protrusion.

17. The device of claim 16, wherein the radiused portion is disposed in the via at a location proximal to the signal connector.

* * * * *